United States Patent [19]

Walsh

[11] Patent Number: 4,976,174

[45] Date of Patent: Dec. 11, 1990

[54] SOCKET WRENCH ATTACHMENT WITH REMOVABLE RETAINING MEANS

[76] Inventor: Arthur Walsh, 143 Salmon Falls Rd., Rochester, N.H. 03867

[21] Appl. No.: 446,080

[22] Filed: Dec. 5, 1989

Related U.S. Application Data

[63] Continuation of Ser. No. 384,688, Jul. 25, 1989, abandoned, which is a continuation of Ser. No. 157,874, Feb. 19, 1988, abandoned.

[51] Int. Cl.[5] ..... B25B 13/02

[52] U.S. Cl. ..... 81/125; 403/95; 403/325; 403/327; 279/77; 279/93

[58] Field of Search ..... 81/124.1, 125, 177.2; 279/77, 89, 93, 94, 106; 403/95, 107, 109, 321, 325–327, 330

[56] References Cited

U.S. PATENT DOCUMENTS

| | | | |
|---|---|---|---|
| 2,965,382 | 12/1960 | Schlage | 279/77 |
| 4,057,260 | 11/1977 | Sigott | 279/77 |
| 4,570,513 | 2/1986 | Thompson | 81/125 |

FOREIGN PATENT DOCUMENTS

| | | | |
|---|---|---|---|
| 291873 | 5/1916 | Fed. Rep. of Germany | 81/124.1 |
| 887027 | 8/1953 | Fed. Rep. of Germany | 81/125 |
| 886132 | 6/1943 | France | 81/125 |

*Primary Examiner*—James G. Smith

*Attorney, Agent, or Firm*—Pearson & Pearson

[57] ABSTRACT

An attachment to a socket wrench and the like carries a rocker arm in a recess in the body of the attachment. The rocker arm rocks about a shaft inserted transversely of the arm in a pair of apertures in the attachment body. At one end of the arm a compression spring seated in a concavity in the attachment body urges a detent carried on the other end of the arm to enter through an opening into the engaging receptacle at the other end of the body.

A nut forced into the engaging receptacle cams the end of the detent outwardly of the receptacle, and when the nut is seated, the action of the spring on the arm causes the nut to be retained. By simply pressing on the arm against the spring, the spring may be further compressed to release a nut in the engaging receptacle.

1 Claim, 1 Drawing Sheet

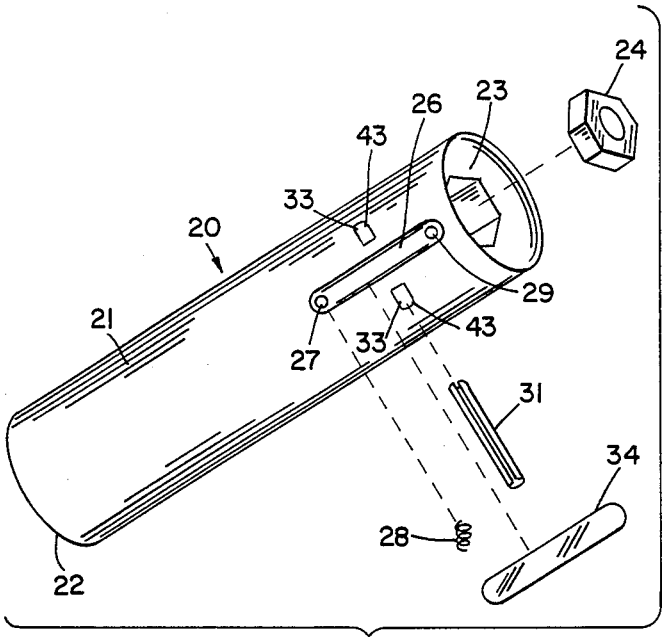
Fig. 1
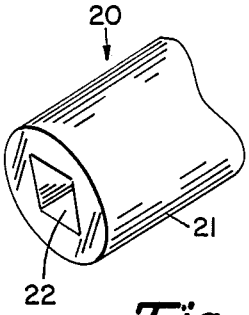
Fig. 2
Fig. 3
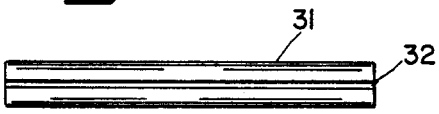
Fig. 4
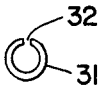
Fig. 5
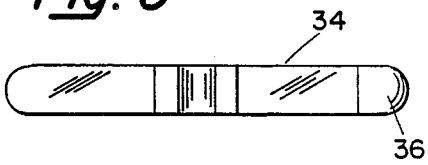
Fig. 6
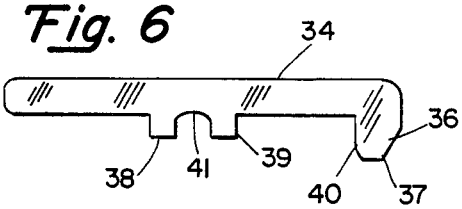
Fig. 7
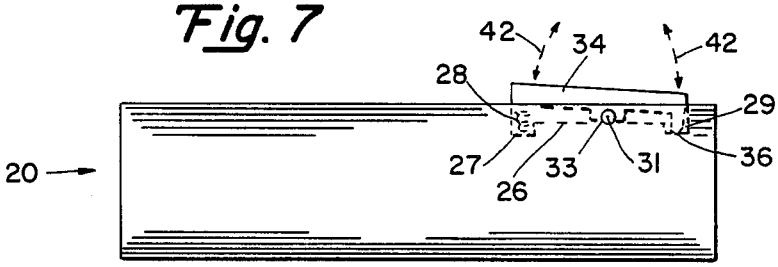
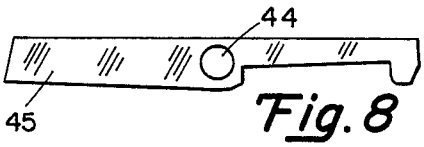
Fig. 8

SOCKET WRENCH ATTACHMENT WITH REMOVABLE RETAINING MEANS

CROSS REFERENCES TO RELATED APPLICATIONS

This application is a continuation of application Ser. No. 07/384,688 filed July 25, 1989 (now abandoned) which, in turn, is a continuation of Ser. No. 07/157,874 filed Feb. 19, 1988 (now abandoned).

BACKGROUND OF THE INVENTION

1. Field of the Invention

The present invention is related to socket wrenches, and more particularly to such wrenches which have a retaining means.

2. Description of Related Art

There are many suggestions for retaining socket wrenches and nut retaining socket attachments or the like. For example, U.S. Pat. No. 1,543,175 to McCarthy June 23, 1925, 26 for Magazine Spanner describes a wrench which retains a plurality of nuts by employing a plurality of shouldered ball nosed plungers 14 formed in the walls of a tube 6 in which excess nuts are retained.

U.S. Pat. No. 2,220,354 to Sheetz Nov. 5, 1940, for Magazine Wrench describes a wrench having spring loaded retaining balls 20 in a groove 21 for retaining nuts.

U.S. Pat. No. 2,704,681 to Fischer Mar. 22, 1955 for Retainer Assembling suggests a split ring 14 held concentric with the axis of the tool shank 10 by an O-ring 16 which retains the retracted nut.

U.S. Pat. No. 2,798,394 to Hubbard July 9, 1957, for Socket Wrench Having Nut-retaining Means describes a head 13 larger than nut 10, with wire springs 20 held tightly against the nut to retain the nut.

U.S. Pat. No. 2,896,489 to Madsen July 28, 1959, for Magazine-Type Socket Wrench suggests a series of circumferentially spaced detents 44 and 46 in the form of balls to retain nuts in a magazine.

U.S. Pat. No. 3,005,367 to Vose Oct. 24, 1961, for Nut-Retaining Socket Wrench describes a resilient retaining ring 34 which is stretched outwardly to admit or release balls from the chamber or magazine.

U.S. Pat. No. 3,416,395 to Hanson Dec. 17, 1968, for Lug Wrench with Storage Magazine and Nut Holding Means suggests ball detents 16 diametrically spaced, to admit or release lug nuts.

U.S. Pat. No. 3,855,883 to Stumpf et al Dec. 24, 1974, for Nut Retaining Socket Wrench describes a nut retainer member or plug 38 to hold the nut 11 in the wrench.

U.S. Pat. No. 4,570,513 to Thompson Feb. 18, 1986, for Wrench with Nut-retaining Mechanism describes a wrench of an ordinary type having a detent 22 actuated by a spring 38 acting through a lever 24 by means of a spring 48. The detent may be de-actuated by a keeper which maintains the spring under compression.

U.S. Pat. No. 4,553,454 to Laskey Nov. 19, 1985, for Nut Retaining Socket with Replaceable Nut Retainer suggests a nut bore retainer consisting of a recessed, cylindrical piece containing an offset looped spring 60 which is caused to retract and release the nut when the nut is driven completely home.

SUMMARY OF THE INVENTION

According to the invention the attachment comprises a longitudinal body having at one end an engaging socket or receptacle and at the other end a socket to receive a socket wrench to drive the nut or bolt. A rocker arm in a recess in the body has a detent at one end which extends through a hole in the engaging receptacle. The other end of the rocker arm bears against a spring in a cavity in the body. The rocker arm rocks about a shaft transversely located in the body. Preferably the detent has a camming surface to cam outward a nut or bolt or the like forced into the engaging socket.

A nut or bolt or the like in the nut engaging socket is held in the socket by action of the spring against the other end of the rocker arm causing pressure of the detent at the one end of the arm against the nut. To release the nut one may simply press against the other end of the rock arm compressing the spring further, thereby releasing the detent and permitting the nut to fall out. A nut may be inserted by pressing the engaging socket against the nut so that the beveled end of the detent will snap out allowing the nut to be retained in the socket. The nut may also be inserted by releasing the detent by pressure against the other end of the rocker arm. Thus the rocker arm may be utilized by pressure or if the camming surface is available, one may if desired simply press the nut into the nut receiving receptacle causing the detent by action of the camming surface to move outwardly. Thereupon the nut now in the receiving receptacle is held in place by the detent. If desired, the lever arm may be pressed down against the spring to permit a nut to be received in the engaging receptacle and after the nut is in the receptacle, the spring action is used to retain the nut.

BRIEF DESCRIPTION OF THE DRAWINGS

The various objects, advantages, and novel features of the invention will be more fully apparent from the following detailed description when read in conjunction with the accompanying drawing, in which like reference numerals refer to like parts, and in which:

FIG. 1 is an exploded view of the attachment with a recess embodying the invention;

FIG. 2 is a partial view of one end only of the attachment with perspective reversed from that of FIG. 1;

FIG. 3 is a side view of a shaft of FIG. 1;

FIG. 4 is an end view of the shaft of FIG. 1;

FIG. 5 is a bottom view of a rocker arm of FIG. 1;

FIG. 6 is a side view of the rocker arm of FIG. 1;

FIG. 7 is a side view of the embodiment of FIG. 1; and

FIG. 8 is a side view of another type of rocker arm.

DESCRIPTION OF ILLUSTRATIVE EMBODIMENTS

Referring to the drawing, a socket attachment 20 comprises a body 21 having at one end a tool engaging receptacle 22 (FIG. 2) and at the other end an engaging socket or receptacle 23, for example to receive a hexagonal nut 24. A longitudinal recess 26 in the body 21 has at one end a depression or concavity 27 which receives the compression spring 28 and at the other end an opening 29 which communicates with the engaging socket or receptacle 23. A hollow split shaft 31, which may be split as at 32 along its entire length, is fitted transversely into apertures 33, one on each side of the longitudinal recess 26. A rocker arm 34 is carried by and fitted onto the shaft 31 between the apertures 33 so that at one end the rocker arm bears against the spring 28. At its other end the rocker arm has a detent or depending finger 36.

The detent 36 at its engaging end 40 has an inwardly projecting face surface 37 which may be rounded or beveled or otherwise shaped to provide a camming action when a nut is forced into the engaging receptacle 23.

As a means to engage the shaft the rocker arm may have two inwardly facing projections or spaced depending legs. These projections 38, 39 are spaced so that as the rocker arm 34 is pressed against the shaft 31 with the projections 38, 39 grasping the shaft 31 between them, thereby compressing the shaft slightly by somewhat closing the split. The rocker arm may also have an orifice 44 as shown in FIG. 8 with a solid body 45 so that the shaft engages the body 45 through the orifice 44 and the rocker arm pivots on said shaft. The resulting action holds the rocker arm 34 on the shaft 31. The space between the projections may be rounded slightly as at 41 to encourage the rocking action of the arm 34 or to fit closely and well on the shaft 31. In other words the shaft 31 is compressible to enable the rocker arm 34 to engage the shaft by means of the projections. The longitudinal axis of the shaft 31 is at right angles to the longitudinal axis of the recess 26 and of the arm 34. When engaged the arm 34 is held by the shaft 31 as a pintle, and the body 21 with apertures 33 act as gudgeons to support the shaft as a pinion. Hence the rocker arm 34 may rock about the shaft 31, in response to pressure against the spring 28. The arrows 42 indicate the rocking action of the rocker arm 34.

Among the advantages of the attachment 20 is that it is readily converted from an ordinary wrench attachment of the type having tool and nut engaging sockets or receptacles. A recess to become recess 26 may be milled form the standard attachment. Then the opening 29 is drilled, and the concavity or depression 27 drilled or formed. The transverse opening 33 are drilled at an appropriate point, and because such an attachment as 20 is often cylindrical, when drilling the transverse apertures 33 for the shaft 31, declivities or hollows 43 result to give access to the apertures 33. Thereafter the previously prepared slit shaft 31 may be forced into the apertures 33; the shaft being compressible admits of its entry into the apertures 33 in which it may be tightly held. Then the previously prepared spring 28 may be inserted into the concavity or depression 27 and the prepared rocker arm forced onto the shaft and against the spring with the detent entered into the opening 29.

A nut, such as nut 24, may be forced into the engaging receptacle causing the camming surface 37 to rotate detent 36 outwardly by rotating the rocker arm 34 against the force exerted by the spring 28. The nut 24 is now held in the engaging receptacle 23 by the detent 36, which engages the nut be reason of the force of the spring 28 exerted against the one end of the rocker arm 34. If it is desired to disengage the nut 24, pressure may be exerted, as manually, against the one end of the rocker arm 34, further compressing the spring 28 sufficiently to rock the arm to withdraw the detent 36 from the nut engaging receptacle 23. The nut is then free to drop out. The nut 24 may have been entered into the nut engaging receptacle 23 in the process of unscrewing it from, or in the process of preparing it for screwing onto, a bolt. The dimensions may be chosen so that the force of a thumb or other finger readily actuates the rocker arm 34 to effectuate release of a nut engaged in the receptacle 23. Such convenience is especially desirable in cases, for example, in which one must unscrew many nuts repetitively from bolts. At the same time as the bolt is withdrawn it is held in the receptacle 23 until its release into a bin or the like is desired.

Accordingly the invention provides a simple, easily and economically constructed socket wrench attachment, which may be made from a standard socket wrench attachment. The attachment is easy to use, and its weight and dimensions may remain little changed from the standard wrench attachment from which it is made. In most instances the assembly of the rocker arm and spring may be readily disassembled. The arm may be grasped by pliers or the like and forced free or snapped from the shaft, essentially restoring the wrench to its operation without the feature of the nut retention. Thereafter, if desired, the spring and arm may be reassembled to reconvert the wrench to operation with the nut retaining feature.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. An attachment for a socket wrench or like tool for engaging a part, said attachment comprising:

A. a cylindrical body having first and second axial end sections and an intermediate section therebetween, said first axial end section being adapted for engagement with the tool and said second axial end section having a part receiving means with an interior surface extending axially into said body from an end opening thereof, said body having an exterior surface coextensive with at least portions of said intermediate and second end sections and including:

i. an axially extending slot of predetermined dimensions formed in the exterior surface of said body and coextensive with portions of said intermediate and second end sections, said slot extending between a first, proximate end spaced from the end opening of said second section and a distal end having a bottom surface thereof, ii. a transverse aperture extending through said body portion between said first end of said slot and said interior surface of said part receiving means, iii. a traverse cavity formed in said body at said distal end of said slot, and iv. an aperture through said body transverse to said slot, intermediate the length thereof and lying above the bottom of said slot;

B. a split compression pin of a predetermined diameter located in said aperture and traversing said slot;

C. a compression spring located in said cavity; and

D. an elongated rocker arm for being disposed in said slot and having:

i. parallel depending legs at an intermediate portion of said rocker arm spaced at a distance that is less than the predetermined diameter of said split compression pin for engaging said split compression pin and for enabling said rocker arm to pivot about said compression spring, said depending legs being opened at the ends thereby to define an opening that enables an individual to remove the rocker arm from said split compression pin, ii. a distal end with respect to said second section of said body for engaging said spring thereby to pivot said distal end away from said body, and iii. a finger depending from the end of said rocker arm proximate said second section, said finger being aligned with said transverse aperture at said proximate end of the slot, said finger having a camming surface formed at the end thereof and a parallel inner latching surface for overlapping the end of a part, said rocker arm being pivoted to compress said spring and release said part and said rocker and said spring being removable by an individual from said body thereby to minimize the cross-sectional profile of said attachment.

* * * * *